US007943200B2

(12) United States Patent
Shimizu et al.

(10) Patent No.: US 7,943,200 B2
(45) Date of Patent: May 17, 2011

(54) METHOD OF CURTAIN COATING

(75) Inventors: Tomohito Shimizu, Numazu (JP); Shuji Hanai, Numazu (JP); Hideyuki Kobori, Numazu (JP); Yasuhide Takashita, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 459 days.

(21) Appl. No.: 12/046,195

(22) Filed: Mar. 11, 2008

(65) Prior Publication Data

US 2008/0226828 A1 Sep. 18, 2008

(30) Foreign Application Priority Data

Mar. 12, 2007 (JP) ..... 2007-061699

(51) Int. Cl.
*B05D 1/30* (2006.01)
*B05D 3/04* (2006.01)

(52) U.S. Cl. ..... 427/420; 427/337

(58) Field of Classification Search ..... 427/337, 427/420

See application file for complete search history.

(56) References Cited

U.S. PATENT DOCUMENTS

| | | | | |
|---|---|---|---|---|
| 3,508,947 | A * | 4/1970 | Hughes | 430/538 |
| 3,773,013 | A | 11/1973 | Parker, Sr. | |
| 4,647,482 | A | 3/1987 | Degrauwe et al. | |
| 6,308,635 | B1 | 10/2001 | Abele | |
| 2003/0104130 | A1 | 6/2003 | Karlsson | |
| 2003/0161955 | A1 | 8/2003 | Brumwell | |
| 2004/0253385 | A1 | 12/2004 | Gueggi | |
| 2005/0074555 | A1 | 4/2005 | Kawabe | |

FOREIGN PATENT DOCUMENTS

| | | | |
|---|---|---|---|
| DE | 19960772 | A1 | 6/2001 |
| EP | 41151 | A2 * | 12/1981 |
| EP | 1338344 | A2 | 8/2003 |
| JP | 6-91979 | | 11/1994 |
| JP | 2000-513 | | 1/2000 |
| JP | 2000-218209 | | 8/2000 |
| JP | 2000-254567 | | 9/2000 |
| JP | 2001-104856 | | 4/2001 |
| JP | 2004-16877 | | 1/2004 |
| JP | 2005-512768 | | 5/2005 |
| WO | WO01/43885 | A1 | 6/2001 |
| WO | WO2006/077277 | A1 | 7/2006 |

OTHER PUBLICATIONS

European search report in connection with a counterpart European patent application No. 08 10 2495 (Aug. 21, 2008).

* cited by examiner

*Primary Examiner* — Timothy H Meeks
*Assistant Examiner* — Nathan H Empie
(74) *Attorney, Agent, or Firm* — Cooper & Dunham, LLP

(57) ABSTRACT

To provide an apparatus and method of curtain coating for applying onto a running web a coating solution from a lip top in the form of curtain to form a coating thereon, wherein a fluid is blown to remove excessive deposits of the coating solution that are formed at the edges in the width direction of the coating, and the deposits blown away by the fluid are ejected.

18 Claims, 2 Drawing Sheets

METHOD OF CURTAIN COATING

BACKGROUND

1. Technical Field

This disclosure relates to an apparatus and method of curtain coating for continuously applying onto a running belt-shaped substrate (hereinafter referred to as a "web") a coating solution in the form of a thin film.

2. Description of the Related Art

There are various known coating apparatus and methods that involve continuous application of coating solution onto a running web surface, with representative examples of coating method including, for example, blade coating, roll coating, wire bar coating, die coating, and curtain coating. The production of materials that require high coating speed (e.g., thermosensitive recording materials, magnetic recording materials, inkjet recording sheets and silver halide photographic photosensitive materials) often employs curtain coating.

The curtain coating method or apparatus includes the steps of discharging through slits coating solution that has been supplied in the manifold of the coating head, retaining a formed thin-film liquid (hereinafter referred to as a "curtain film" or "curtain") at the curtain edge guides that are provided at both sides of the coating head so as to face the coating surface of the web, and allowing the curtain film to fall down onto the running web surface to thereby form a coating film that covers the web surface.

When the curtain width is to be made equal to or less than the web width upon curtain coating that applies a curtain of coating solution onto a coating surface of the web in a gap formed between the curtain edge guides and coating surface, the coating solution is drawn to the center of the coating film in the width direction. This leads to a so-called "neck-in" phenomenon in which excessive deposition of the coating solution occurs at the edge of the coating, as shown in FIG. 1. Note in FIG. 1 that reference symbol 1 denotes an excessive deposit at the coating edge, reference symbol 2 denotes a coating, and reference symbol 3 denotes a web.

This excessive deposit causes dry process failure in the subsequent drying step conducted using a dryer, leading to stains on the web transporting roll after passing through the dryer and/or on the edges of the backside of the web when it is taken up. Even when the excessive deposit has been fully dried in a drier, the take-up unit for coated paper provided in the coater takes up the coated paper with the position of the excessive deposit being at the same level in the roll. This leads to unwanted thickening or raised portions in the roll where the excessive deposit is formed, leading to web breakage.

In an effort to avoid generation of such excessive deposits at the coating edges, Japanese Patent Application Laid-Open (JP-A) Nos. 2000-513, 2000-218209, 2001-104856 and 2005-512768 each disclose a method of making the flow rates of the coating solution at opposite sides of the slide surface close to the flow rate at the center of coating solution by feeding an auxiliary solution along the opposite edges of the slide surface, but each method requires a large amount of auxiliary solution because it is fed along the guide edges. For this reason, the auxiliary solution becomes more likely to be mixed with the coating solution fed along the edge guides, or the auxiliary solution flow rate become uneven along the edge guides; therefore, stable deposition amounts cannot be ensured at the coating edges, leading to defective products. Moreover, there is a drawback that these methods require a complex coater.

JP-A No. 2000-254567 discloses a method of removing excessive deposits at the lower edges of curtain edge guides by suction. This method, however, can remove excessive deposits only when the suction nozzles are placed in contact with or in close vicinity of the excessive deposits. To achieve removal it is required to make the distance between the suction nozzle and web considerably small, but this causes dusts attached on the running web surface to get stuck on the nozzles and triggers web breakage.

JP-A No. 2004-16877 discloses a coating method that applies a coating solution on a web while creating uncoated portions on both sides of the web by making the curtain width larger than the web width and by folding both sides of the web at the upstream from the position where the curtain collides with the web surface. Although this method entails no generation of excessive deposits at the coating edges indeed, the curtain needs to be larger in width than the web, and in addition, portions of the coating solution that exceed the width of the web are not applied onto the web. In the case of a single layer coating, however, there is no problem since the coating is formed using one coating solution and thus the coating solution can be reused. On the other hand, in the case of a multilayer coating formed of layers of different coating solutions, these coating solutions cannot be reused and should be discarded, significantly reducing the productivity.

Japanese Patent Application Publication (JP-B) No. 06-91979 discloses a coating method that prevents excessive deposits formed at both sides of the curtain coating from being in contact with the web by making the web width smaller than the lip tip width. In this method, however, portions of the coating solution exceeding the width of the web fail to be applied onto the web; therefore, this coating method has the same technical problem as the method disclosed in JP-A No. 2004-16877.

Another approach to overcome the above-mentioned problem is to remove, by means of vacuum, portions of coating solution that have been excessively deposited at the edges of the coating after deposition of the coating on the web, but it is difficult to remove only such excessive deposits at the edges and it is often the case that it results in unwanted removal of portions of the coating solution that are close to the center of the coating in its width direction.

BRIEF SUMMARY

In an aspect of this disclosure, there is provided an apparatus and method of curtain coating that are capable of stable, continuous slide curtain coating over a long time by removing excessive deposits at the edges of coating that are generated upon slide curtain coating for applying coating solution in layers onto a running web, while avoiding the generation of stains on non-coated areas, edges and backside of the web and on other nearby components due to the removed coating solution.

In addition, the following aspects may be provided.

(1) A curtain coating method including: applying onto a continuously running web a coating solution in the form of curtain from a lip tip to form a coating thereon, wherein a fluid is applied to the coating for removing excessive deposits of the coating solution which are formed at edges in the width direction of the coating while ejecting the excessive deposits.

(2) The curtain coating method according to (1), wherein the fluid is air.

(3) The curtain coating method according to (1), wherein the fluid is air mixed with a main solvent of the coating solution.

(4) The curtain coating method according to any one of (1) to (3), wherein portions of the coating solution blown away are ejected into an ejection block using a fluid fed from an ejection nozzle, the ejection block being C-shaped and disposed such that the web is accommodated in its internal space, the ejection nozzle being provided to a wall surface of the ejection block, the surface being perpendicular to a surface of the coating.

(5) The curtain coating method according to (4), wherein an angle between a blow nozzle for blowing the fluid to the edges of the coating in the width direction and a surface of the coating, a vertical angle, is set to 10° to 30°, the angle being 0° when the blow nozzle is horizontal to the surface of the coating.

(6) The curtain coating method according to (4), wherein an angle between the blow nozzle and a web running direction, which angle is formed when the blow nozzle moves against the web running direction, a counter angle, is set to 0° to 30°, the counter angle being 0° when the direction in which the blow nozzle discharges the fluid is in parallel with the web running direction.

(7) The curtain coating method according to one of (5) and (6), wherein the vertical distance between the tip of the blow nozzle and the surface of the coating is set to 1 mm to 5 mm.

(8) The curtain coating method according to any one of (5) to (7), wherein the air pressure of the blow nozzle is set to 0.1 MPa to 0.5 MPa.

(9) The curtain coating method according to any one of (5) to (8), wherein a suction device is connected to the ejection block for suctioning the portions of the coating solution blown away.

(10) The curtain coating method according any one of (4) to (9), wherein fluid blowing is conducted in conformity with meandering of the web by using a web edge position signal received from a web edge position detection sensor for detecting meandering of the web, and the portions of the coating solution blown away by the fluid are ejected or suctioned.

(11) The curtain coating method according to any one of (1) to (10), wherein a coating formed of a plurality of layers of the coating solution is formed by allowing the coating solution to fall from the lip top in the form of curtain.

(12) A curtain coating apparatus for continuously applying a coating solution onto a running web from a lip top in the form of curtain to form a coating thereon, the apparatus including: a fluid blowing unit configured to blow a fluid to blow away excessive deposits of the coating solution formed at edges in the width direction of the coating; and an ejection unit configured to remove the excessive deposits blown away.

(13) The curtain coating apparatus according to (12), wherein the fluid is air.

(14) The curtain coating apparatus according to (12), wherein the fluid is air mixed with a main solvent of the coating solution.

(15) The curtain coating apparatus according to any one of (12) to (14), wherein the ejection unit is formed by providing an ejection block and an ejection nozzle.

(16) The curtain coating apparatus according to (15), further including a device capable of adjusting a vertical angle of the fluid blowing unit to from 10° to 30°, wherein the fluid blowing unit is a blow nozzle.

(17) The curtain coating apparatus according to (16), further including a device capable of adjusting a counter angle of the blow nozzle to 0° to 30°.

(18) The curtain coating apparatus according to one of (16) and (17), further including a device capable of adjusting a vertical distance between the tip of the blow nozzle and a surface of the coating to from 1 mm to 5 mm

(19) The curtain coating apparatus according to any one of (16) to (18), further including a device capable of adjusting the air pressure of the blow nozzle to from 0.1 MPa to 0.5 MPa.

(20) The curtain coating apparatus according to any one of (15) to (19), further including a suction device connected to the ejection block for suctioning the portions of the coating solution blown away by the fluid discharged from the blow nozzle.

(21) The curtain coating apparatus according to any one of (16) to (20), further including a web edge position detection sensor for detecting meandering of the web, wherein fluid blowing is conducted in conformity with meandering of the web by using a web edge position signal output from the web edge position detection sensor, and the portions of the coating solution blown away by the fluid are ejected or suctioned.

(22) The curtain coating apparatus according any one of (12) to (21), wherein as a coating nozzle for allowing the coating solution to fall from the lip top in the form of curtain to form a coating formed of a plurality of layers of the coating solution, a slide hopper type nozzle is employed in which the coating solution flows down on an inclined surface of a slide of a coating head to form a curtain from the lip top at a lower end of the slide.

As it will be clear from the following description and Examples, according to the aforementioned coating apparatus and method, it is possible to achieve stable, continuous production of coating over a long time by removing excessive deposits at the edges of coating that are generated upon slide curtain coating, while avoiding the generation of stains on non-coated areas, edges and backside of the web and on other nearby components due to the removed coating solution.

DETAILED DESCRIPTION OF THE INVENTION

The present invention is detailed below with reference to the drawings.

Figure 1:
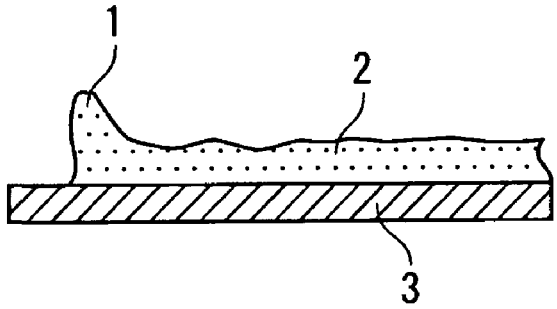
FIG. 1 illustrates how an excessive deposit of coating solution is formed at the edge of coating.
Figure 2:
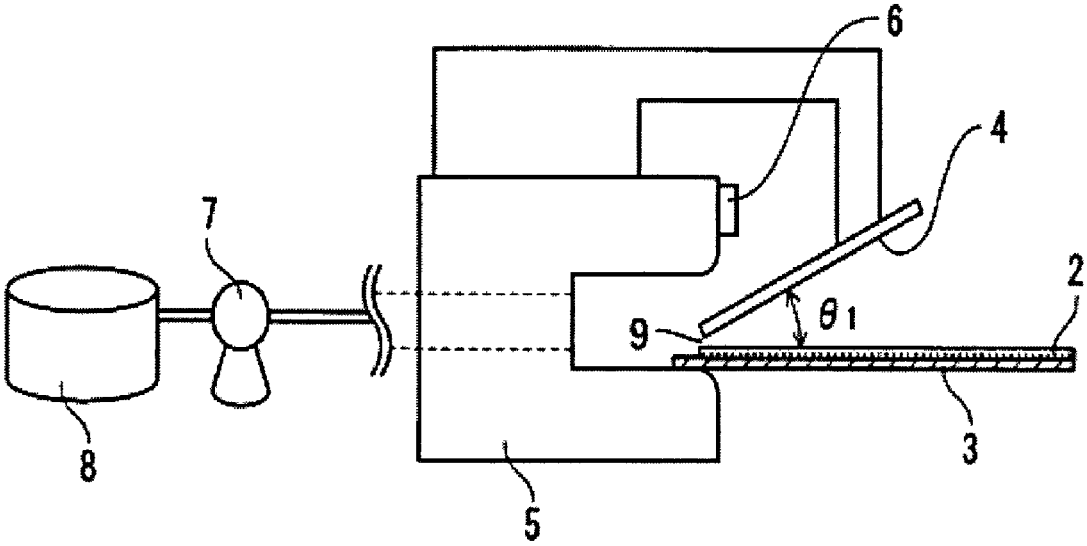
FIG. 2 illustrates how portions of coating solution that have been excessively deposited at the edges of the web in its width direction are removed in an ejection block.
Figure 3:
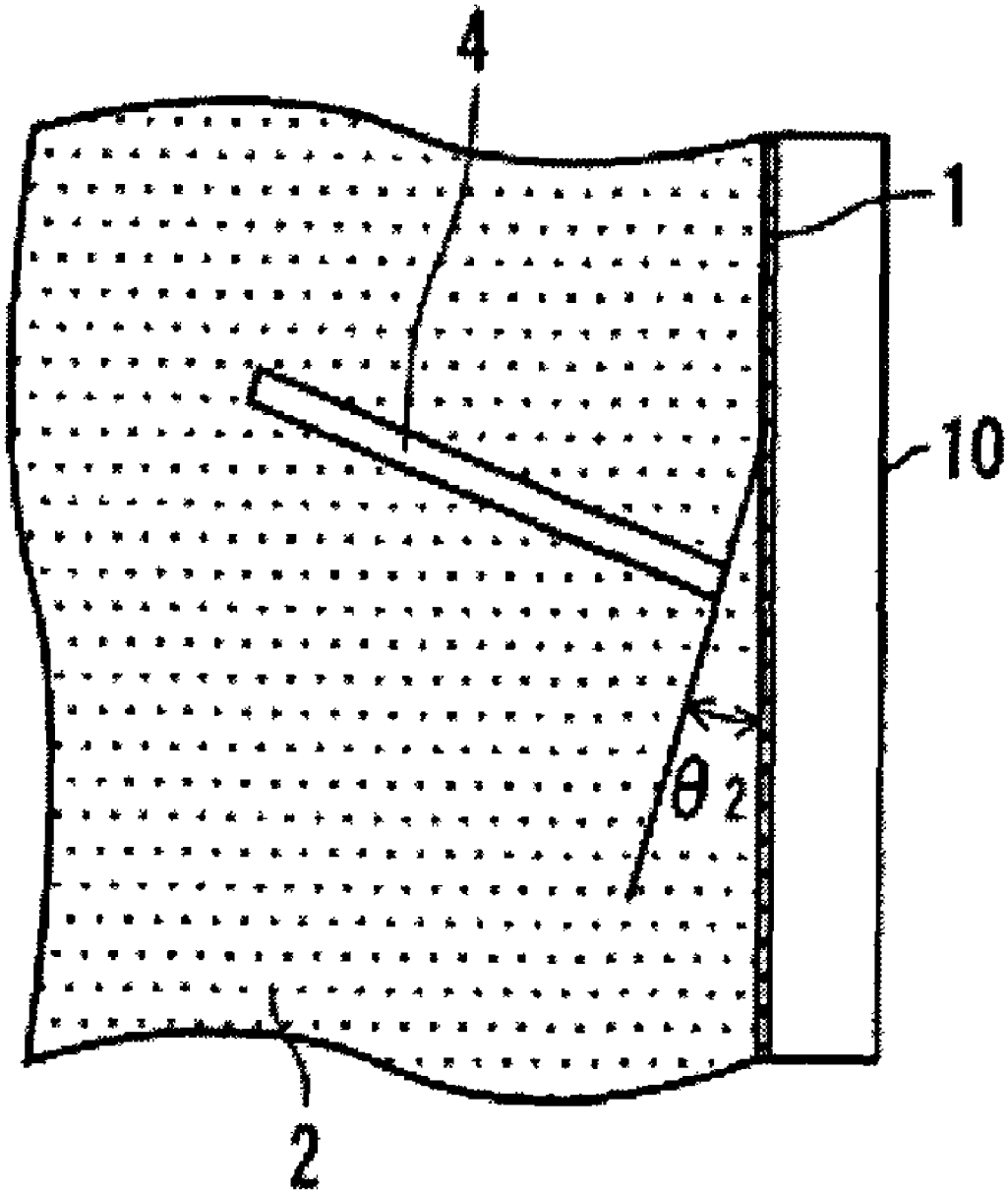
FIG. 3 illustrates a blowing angle of a blow nozzle.

FIG. 2 illustrates how excessive deposits of coating solution are blown away by a fluid supplied by fluid blowing means (blow nozzle 4) and are ejected to the outside by gas discharged from an ejection nozzle 6 mounted to an ejection block 5.

More specifically, in accordance with the aspects of this disclosure it is possible to remove excessive deposits of coating solution while avoiding generation of stains on non-coated areas and backside of the web by blowing away the excessive deposits at the coating edges by a fluid supplied by the blow nozzle 4 and by ejecting, and more preferably further suctioning, both of the fluid and deposits.

As the fluid to be applied to excessive deposits of coating solution, compressed air generated by an air compressor, blower air generated by an air blower, dehumidified air, etc. can be employed. Furthermore, when the coating solution has a high viscosity, it works against removal of coating solution. For this reason, for the purpose of increasing the mass of the fluid to be blown to excessive deposits, air mixed with an atomized solvent used as a main solvent of the coating solution is employed. In this way, excessive deposits can be removed even in the case of high-viscosity coating solution.

The ejection nozzle 6 is provided to a wall surface of the ejection block 5 that is perpendicular to the coating surface. By feeding gas along this wall surface, gas discharged from the ejection nozzle 6 runs along the wall surface of the ejection block 5 without colliding with a web 3 and the coating surface. Since the ejection block 5 is C-shaped and disposed such that the web 3 is accommodated in its internal space, the gas discharged from the ejection nozzle 6 flows toward the edges of coating in the width direction. This allows both the fluid discharged from the blow nozzle 4 and removed excessive deposits of coating solution to be carried away by the gas discharged from the ejection nozzle 6 to the outside, whereby it is made possible to remove excessive deposits while avoiding generation of stains on non-coated areas and backside of the web 3.

The above configuration in which the ejection block 5 has a C shape and the web edges are accommodated into its internal space provides support to the web edges during fluid application. Thus, it is made possible to reduce vibration of the web caused by blowing of fluid and to reduce variations in the amount of excessive deposit blown away due to web vibration.

Here, examples of materials of the blow nozzle 4, ejection nozzle 6 and ejection block 5 include, but not specifically limited to, plastic materials, iron, and stainless steel for industrial uses.

The blow nozzle 4 is provided with a function that allows its vertical angle (θ1) and counter angle (θ2) with respect to coating surface to be adjustable. The mechanism for adjusting the vertical angle (θ1) and counter angle (θ2) is not specifically limited as long as they are adjusted; however, it is preferable to employ a Gonio stage as a mechanism that enables simple, precise angle adjustment.

The blow nozzle 4 is also provided with a function that allows its vertical distance (the distance between the tip of the blow nozzle 4 and coating surface) to be adjustable. The mechanism for adjusting this distance is not specifically limited; however, it is preferable to employ an XY stage or XYZ stage as a mechanism that enables simple, precise distance adjustment. Moreover, the blow nozzle 4 is provided with a function that allows blow air pressure to be adjustable.

In the coating apparatus of this disclosure, it is preferable that the ejection block 5 be further connected to a suction device 7 for suctioning the coating solution blown away by means of the blow nozzle 4. By applying coating solution onto the web while suctioning the coating solution blown away, it is possible to achieve more efficient removal of excessive deposits without contaminating the atmosphere.

Here, the suction device 7 is not specifically limited in terms of method of suctioning as long as it is a device or machine capable of suction, which adopts a suction system like a vacuum cleaner, blower, or vacuum pump.

It is preferable to further provide at least one of the blow nozzle 4, ejection nozzle 6 and ejection block 5 with a web edge position detection sensor (not shown) for detecting generation of web meandering caused by vibration.

By conducting fluid blowing and removal of excessive deposits in conformity with the meandering of the web 3 based on the web edge position signal received from this sensor, it is possible to remove excessive deposits uniformly along the web running direction.

The degree of web meandering increases with increasing coating speed. In practice, even when the coating apparatus is so controlled that web meandering is suppressed by such a web edge position detection sensor, web meandering at a level of 1-2 mm in width direction inevitably occurs. Thus, blowing fluid on excessive deposits in conformity with web meandering enables the fluid to be fully blown against excessive deposits along the web running direction.

Here, the detection system adopted in the web edge position detection sensor is not specifically limited.

During the use of the coating apparatus, excessive deposits of coating solution can be blown away by changing the vertical angle (θ1) in a range of from 10° to 30°. When the vertical angle (θ1) is smaller than 10°, it results in failure to blow away excessive deposits. When the vertical angle (θ1) is greater than 30°, the blown fluid fails to smoothly flow toward the web edges from the coating center after collided with excessive deposits, and some portions of the fluid flow toward the coating center in the width direction, which in turn leads to generation of excessive deposits at the edges of coating.

During use of the coating apparatus, excessive deposits of coating solution can be blown away by changing the counter angle (θ2) of the blow nozzle 4 in a range of from 0° to 30°. When the counter angle (θ2) is greater than 30° with respect to the running direction of the web 3, the excessive deposits are not blown away toward the edges of coating in width direction and thus cannot be removed.

When the counter angle (θ2) is less than 0°, i.e., tilted to the opposite direction, the fluid discharged from the blow nozzle 4 flows in the same direction that the web 3 runs, resulting in failure to remove excessive deposits.

In addition, during use of the coating apparatus, it is possible to blow away excessive deposits of coating solution by setting the vertical distance of the blow nozzle 4 to 1-5 mm. While it is possible blow away excessive deposits by setting the vertical distance to less than 1 mm, in this case it becomes more likely that dusts or the like attached to the web 3 get stuck on the tip of the blow nozzle 4, thereby increasing the likelihood of linear scratches along the length of the web. When the vertical distance is greater than 5 mm, the effect of blowing fluid to the excessive deposits decreases and thus they cannot be to removed.

Furthermore, during use of the coating apparatus, it is possible to blow away excessive deposits by setting the air pressure of the blow nozzle 4 to 0.1-0.5 MPa. An air pressure of less than 0.1 MPa results in failure to remove excessive deposits. Moreover, when the air pressure is greater than 0.5 MPa, the blown fluid fails to smoothly flow toward the web edges from the coating center after collided with excessive deposits, and some portions of the fluid flow toward the coating center in the width direction, which in turn leads to generation of excessive deposits at the edges of coating. In addition, the degree of web meandering increases and air blows to excessive deposits intermittently; therefore, the excessive deposits cannot be removed uniformly along the web running direction.

EXAMPLES

Hereinafter, the present invention will be described in more detail with reference to Examples, which however shall not be construed as limiting the scope of the present invention in any way.

As shown in FIG. 2, under the following common coating condition, coating solutions were respectively applied onto running webs using a slide curtain apparatus equipped with fluid blowing means for removing portions of coating excessively deposited onto the web. The resultant coatings were then evaluated.

[Common Coating Condition]

(1) Coating base: Paper sheet with a basis weight of 60 g/m$^2$ (2) Coating solution: 7.5 wt % aqueous PVA solution (3) Viscosity of coating solution: 300 mPa s (4) Coating speed: 500 m/min (5) Intended average deposit amount: Wet 50 g/m$^2$ (6) Coating width: 1,000 mm (7) Vertical angle (θ1) of blow nozzle: 15°

(8) Counter angle (θ2) of blow nozzle: 5°

(9) Vertical distance: 3 mm

(10) Air pressure of blow nozzle: 0.3 MPa

(11) Suction device: Vacuum cleaner connected to ejection block

(12) Air pressure of ejection nozzle: 0.5 MPa

[Evaluation]

Using a contact-type electron digital micrometer "K351C" (manufactured by Anritsu Corp.), the coating was evaluated for the thicknesses of excessive deposit portions and nearby web portions (alternately measured at 30 points in total), and the average thickness value for the nearby web portions was subtracted from the average thickness value for the excessive deposit portions to determine the thickness of the excessive deposit.

In Table 1 where results of Examples and Comparative Example are shown, the excessive deposit thickness is expressed as a percentage of the coating center thickness.

The non-coated areas (edges) and backside of the web were evaluated for the amount of stain by visual observation.

Example 1

A coating solution was applied using the above common coating condition.

Example 2

A coating solution was applied using the above common coating condition except that the vertical angle was increased in 5-degree steps from 5° to 35°.

Example 3

A coating solution was applied using the common coating condition except that the counter angle was increased in 5-degree steps from −5° (an angle in which the fluid is discharged from the blow nozzle 4 in the same direction that the web runs) to 35°.

Example 4

A coating solution was applied using the common coating condition except that the vertical distance from the tip of the blow nozzle to the coating was set to 0.5 mm and changed in 1-mm steps from 1 mm to 6 mm.

Example 5

A coating solution was applied using the common coating condition except that the air pressure of the blow nozzle was set to 0.05 MPa and changed in 0.1-MPa steps from 0.1 MPa to 0.6 MPa.

Comparative Example 1

A coating solution was applied using the common coating condition except that no air was blown to excessive deposits of coating.

Evaluation results are summarized in Table 1 below.

TABLE 1

| | Condition | | | | | |
|---|---|---|---|---|---|---|
| | Vertical angle (degree) | Counter angle (degree) | Vertical distance (mm) | Air pressure (MPa) | Excessive deposit thickness (%) | Stains on non-coated areas and backside of web |
| Ex. 1 | 15 | 5 | 3 | 0.5 | 101 | None |
| Ex. 2 | 5 | 5 | 3 | 0.5 | 180 | Small amount of stain |
| | 10 | 5 | 3 | 0.5 | 102 | None |
| | 15 | 5 | 3 | 0.5 | 101 | None |
| | 20 | 5 | 3 | 0.5 | 105 | None |
| | 25 | 5 | 3 | 0.5 | 104 | None |
| | 30 | 5 | 3 | 0.5 | 105 | None |
| | 35 | 5 | 3 | 0.5 | 150 | Small amount of stain |
| Ex. 3 | 15 | −5 | 3 | 0.5 | 125 | Small amount of stain |
| | 15 | 0 | 3 | 0.5 | 101 | None |
| | 15 | 5 | 3 | 0.5 | 101 | None |
| | 15 | 10 | 3 | 0.5 | 102 | None |
| | 15 | 15 | 3 | 0.5 | 102 | None |
| | 15 | 20 | 3 | 0.5 | 102 | None |
| | 15 | 25 | 3 | 0.5 | 105 | None |
| | 15 | 30 | 3 | 0.5 | 104 | None |
| | 15 | 35 | 3 | 0.5 | 145 | Small amount of stain |
| Ex. 4 | 15 | 5 | 0.5 | 0.5 | 98 | Small amount of stain (linear scratchs occurred due to dusts attached to nozzle) |
| | 15 | 5 | 1 | 0.5 | 99 | None |
| | 15 | 5 | 2 | 0.5 | 101 | None |
| | 15 | 5 | 3 | 0.5 | 101 | None |
| | 15 | 5 | 4 | 0.5 | 105 | None |
| | 15 | 5 | 5 | 0.5 | 105 | None |
| | 15 | 5 | 6 | 0.5 | 155 | Small amount of stain |
| Ex. 5 | 15 | 5 | 3 | 0.05 | 122 | Small amount of stain |
| | 15 | 5 | 3 | 0.1 | 103 | None |
| | 15 | 5 | 3 | 0.2 | 104 | None |
| | 15 | 5 | 3 | 0.3 | 101 | None |

TABLE 1-continued

| | Condition | | | | | |
|---|---|---|---|---|---|---|
| | Vertical angle (degree) | Counter angle (degree) | Vertical distance (mm) | Air pressure (MPa) | Excessive deposit thickness (%) | Stains on non-coated areas and backside of web |
| | 15 | 5 | 3 | 0.4 | 101 | None |
| | 15 | 5 | 3 | 0.5 | 101 | None |
| | 15 | 5 | 3 | 0.6 | 129 | Small amount of stain |
| Comp. Ex. 1 | No air blow | | | | 320 | Large amount of stain |

Example 6

A coating solution was applied using the common coating condition except that misty air containing moisture was employed instead of air discharged from the blow nozzle. As a result, the same effect as that in Example 1 was confirmed.

Example 7

A coating solution was applied using the common coating condition except that 10 wt % aqueous PVA solution was employed as coating solution, that coating speed was set to 500 m/min, and that air used in Example 6 was employed as a gas to be blown. As a result, the same effect as that in Example 1 was confirmed.

As it is clear from the description given above, the coating apparatus and method can realize stable, continuous production of coating over a long time by removing excessive deposits at the edges of coating that are generated upon slide curtain coating while avoiding the generation of stains on non-coated areas, edges and backside of the web and on other nearby components due to the removed coating solution. In addition, the coating apparatus and method are useful in the production of materials that require high coating speed, such as thermosensitive recording materials, magnetic recording materials, inkjet recording sheets, and silver halide photographic photosensitive materials.

What is claimed is:

1. A curtain coating method comprising:

(a) applying onto a continuously running web a coating solution in the form of curtain from a lip tip to form a coating thereon;

(b) applying a fluid to the coating to remove excessive deposits of the coating solution which are formed at an edge of the coating in a width direction of the coating; and (c) discharging a gas from an ejection nozzle having an outlet positioned above and outside of an ejection block, the discharged gas flowing along an exterior surface of the ejection block toward said edge, the gas discharged in (c) and the fluid applied in (b) removing the excessive deposits from the coating into said ejection block.

2. The curtain coating method according to claim 1, wherein the fluid is air.

3. The curtain coating method according to claim 1, wherein the fluid is air mixed with a main solvent of the coating solution.

4. The curtain coating method according to claim 1, wherein the ejection block is C-shaped and disposed such that the web is accommodated in its internal space, and said exterior surface on which the ejection nozzle is positioned is a wall surface of the ejection block, the wall surface being perpendicular to a surface of the coating.

5. The curtain coating method according to claim 4, wherein an angle between a blow nozzle and a web running direction, which angle is formed when the blow nozzle moves against the web running direction, a counter angle, is set to 0° to 30°, the counter angle being 0° when the direction in which the blow nozzle discharges the fluid is in parallel with the web running direction.

6. The curtain coating method according to claim 4, wherein fluid blowing is conducted in conformity with meandering of the web by using a web edge position signal received from a web edge position detection sensor for detecting meandering of the web, and portions of the coating solution blown away by the fluid are ejected or suctioned.

7. The curtain coating method according to claim 4, wherein an angle between a blow nozzle for blowing the fluid to the edges of the coating in the width direction and a surface of the coating, a vertical angle, is set to 10° to 30°, the angle being 0° when the blow nozzle is horizontal to the surface of the coating.

8. The curtain coating method according to claim 7, wherein a vertical distance between a tip of the blow nozzle and the surface of the coating is set to 1 mm to 5 mm.

9. The curtain coating method according to claim 7, wherein the air pressure of the blow nozzle is set to 0.1 MPa to 0.5 MPa.

10. The curtain coating method according to claim 1, wherein a coating formed of a plurality of layers of the coating solution is formed by allowing the coating solution to fall from the lip top in the form of curtain.

11. The curtain coating method according to claim 1, wherein said exterior surface is C-shaped in a direction perpendicular to a surface of the coating, and the gas discharged from the ejection nozzle in (c) flows along said C-shaped exterior surface to remove the excessive deposits into said ejection block.

12. The curtain coating method according to claim 1, wherein the gas discharged from the ejection nozzle in (c) is directed toward a portion of the ejection block adjacent to the edge of the coating such that the discharged gas does not collide substantially with the coating.

13. The curtain coating method according to claim 1, wherein said edge of the coating is accommodated into an internal space of the ejection block, such that the internal space supports said edge of the coating during the application of the fluid in (b).

14. The curtain coating method according to claim 1, further comprising suctioning, from said ejection block, the excessive deposits removed from the coating into the ejection block by the fluid applied in (b) and by the gas discharged in (c).

15. The curtain coating method according to claim 1, wherein the gas discharged in (c) moves the fluid applied to the coating in (b) into said ejection block.

16. The curtain coating method according to claim 1, wherein the gas discharged in (c) contacts with the fluid applied in (b) and the excessive deposits removed from the coating by the fluid applied in (b), and the discharged gas carries the fluid and the excessive deposits into said ejection block.

17. The curtain coating method according to claim 1, wherein an air pressure of the ejection nozzle is set to approximately 0.5 MPa.

18. A curtain coating method comprising:

(a) applying onto a continuously running web a coating solution to form a coating thereon;

(b) applying a fluid to the coating to remove excessive deposits of the coating solution which are formed at an edge of the coating; and (c) discharging a gas from an ejection nozzle positioned above the coating, onto a C-shaped exterior wall surface of an ejection block, the discharged gas flowing along said C-shaped exterior surface of the ejection block towards said edge to thereby carry the fluid applied in (b) and the excessive deposits removed in (b), into said ejection block.

* * * * *